United States Patent [19]

Metje

[11] 4,259,904

[45] Apr. 7, 1981

[54] ALIGNMENT SYSTEM FOR OFFSET PRINTING PRESSES

[76] Inventor: Heinz Metje, Mittel Str. 21, 5653 Leichlingen, Fed. Rep. of Germany

[21] Appl. No.: 59,647

[22] Filed: Jul. 23, 1979

Related U.S. Application Data

[63] Continuation of Ser. No. 818,388, Jul. 25, 1977, abandoned.

[51] Int. Cl.[3] ..... B41F 27/12

[52] U.S. Cl. ..... 101/415.1; 101/DIG. 12; 101/401.1; 33/184.5

[58] Field of Search ..... 101/415.1, 378, DIG. 12, 101/401.1, 401.3; 33/184.5; 72/320, 319, 333, 335, 337, 379; 83/40, 33, 515, 613, 669, 637, 628

[56] References Cited

U.S. PATENT DOCUMENTS

| | | | |
|---|---|---|---|
| 2,192,924 | 3/1940 | Maher et al. | 101/401.1 |
| 2,776,594 | 1/1957 | Garity | 101/DIG. 12 |
| 3,160,096 | 12/1964 | Norton | 101/DIG. 12 |
| 3,288,063 | 11/1966 | Bungay, Jr. | 101/401.1 |
| 3,451,337 | 6/1969 | Updegraff | 33/184.5 X |
| 3,456,587 | 7/1969 | Hulen | 101/415.1 |
| 3,751,817 | 8/1973 | Willis | 33/184.5 |

FOREIGN PATENT DOCUMENTS

| | | | |
|---|---|---|---|
| 633393 | 7/1936 | Fed. Rep. of Germany | 101/415.1 |
| 817308 | 10/1951 | Fed. Rep. of Germany | 101/415.1 |
| 2045953 | 9/1970 | Fed. Rep. of Germany | 101/415.1 |
| 1539769 | 9/1968 | France | 101/DIG. 12 |

OTHER PUBLICATIONS

M&A, M&A Pass-System GmbH, H. Metje, Mittelstr. 21, Leichlingen, "Das Pab-System mit MaB-Permanenz," Mar. 1977.

*Primary Examiner*—J. Reed Fisher

*Attorney, Agent, or Firm*—Jones, Thomas & Askew

[57] ABSTRACT

An alignment system for the positioning of printing plates on offset printing presses which have an axially extending fastening channel. The system includes of a stamping machine for the punching out of register holes in the printing plate and the related plate masks, a premount table, a bending device for the printing plate and a blocking piece in the fastening channel.

8 Claims, 14 Drawing Figures

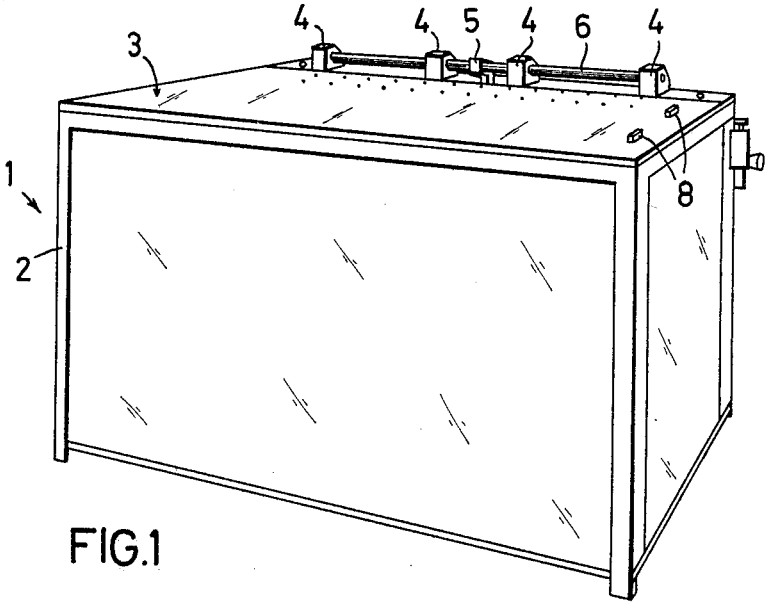
FIG.1
FIG.2
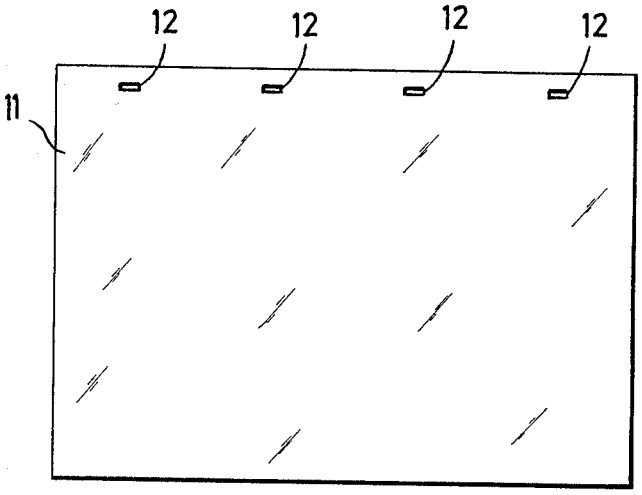

FIG.3
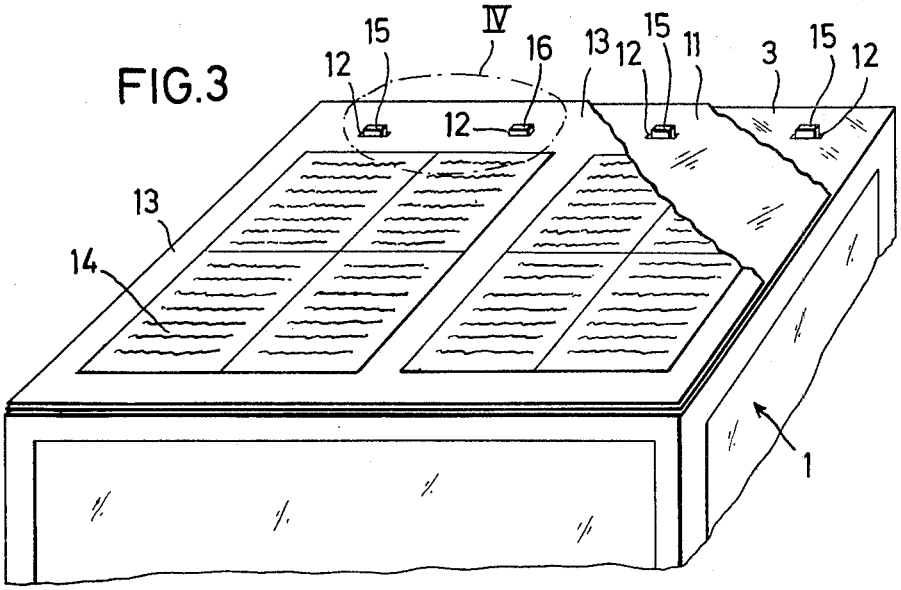
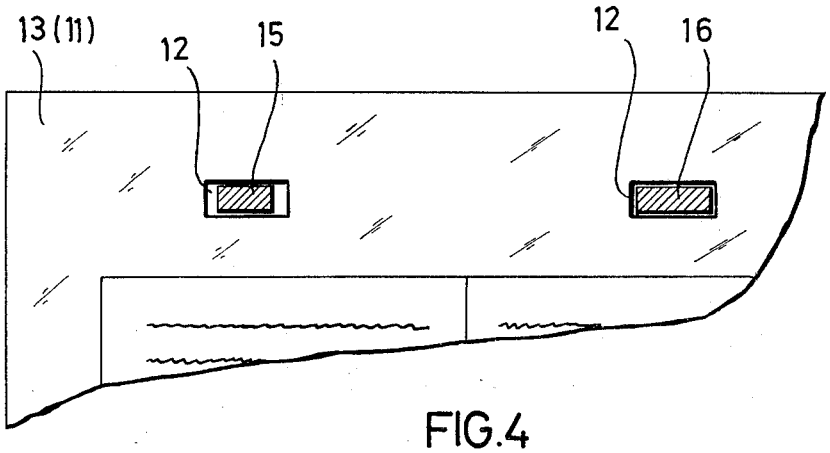
FIG.4

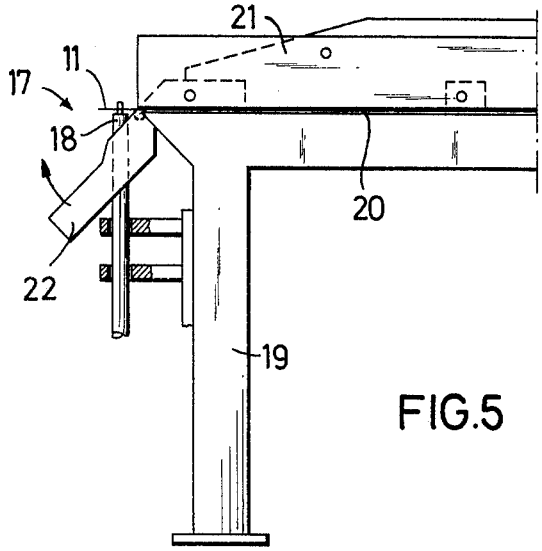
FIG.5
FIG.6
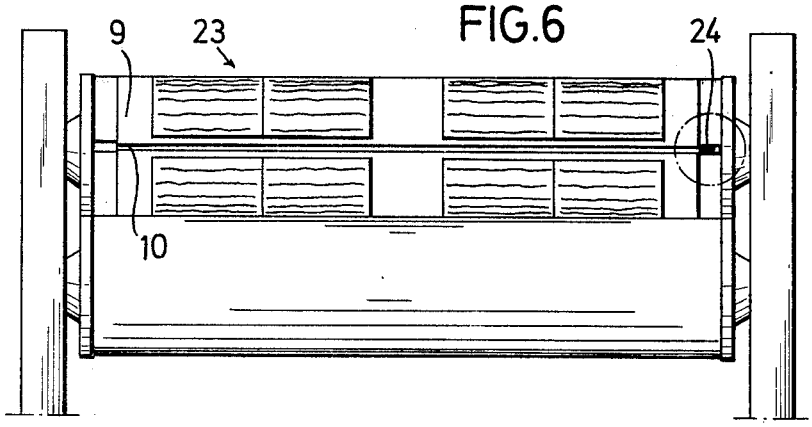
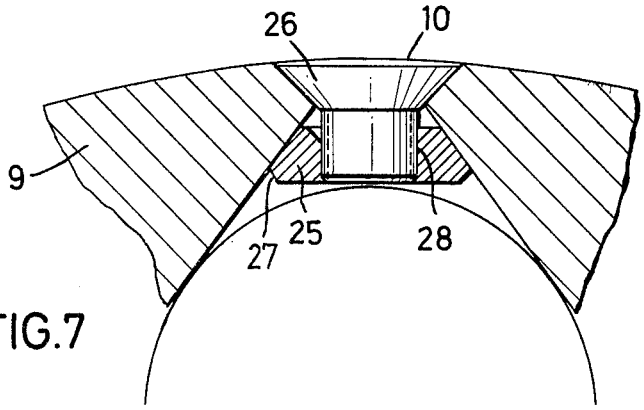
FIG.7

ALIGNMENT SYSTEM FOR OFFSET PRINTING PRESSES

This is a continuation of application Ser. No. 818,388, filed July 25, 1977, now abandoned.

From German Pat. No. 2,045,953.4, an alignment system for offset printing machines is known, whereby the printing plate is furnished with register holes on its edges which run circumferentially to the plate cylinders, and the blocking pieces in the fastening channel engage these register holes of the printing plate, through which an exact alignment of the printing plate becomes possible. Furthermore, the printing plates are furnished with opened and closed perforation for the centering of the printing plate in the bending device and for the centering of the mask on the printing plate. This well-known system, however, has the disadvantage that on the one hand a great number of different register holes is necessary, whereby the possibility of the occurrence of inaccuracies is promoted, and in addition, the perforations do not produce an exact positioning surface, the result being that an exact centering of the printing plate on the bending device and of the mask on the printing plate is difficult to achieve and must follow with the help of optical measurements. Furthermore, the ability to repeat the positioning accurately for a number of different printing plates, for example in connection with color printing, will, in any case, only be arrived at after great expense of readjustment.

From U.S. Pat. No. 3,456,587, a positioning device is known by which register pins are attached to a base part or housing, said housing being furnished with a long slot by which it can be fastened with a screw in varying positions. As a result the register pins are adjustable, and exact positioning is possible only through difficult and expensive adjustments, and the subsequent slipping of printing plates circumferentially around the printing cylinders cannot be avoided. Another point is that the register pins associated with this well-known arrangement serve a purpose only in preparatory adjustments, and the exact aligning results from the gripping and stretching of the printing plate after which the register pins are pushed down and out of the way. Therefore, for the time being, at least one test print is required, in order to firmly establish the correct printing position of the printing plate. If this printing position is not reached, then the plate must be unfastened after which the register pins can no longer reach back into the respective pin openings. Moreover, the register pins possess a circular profile, so that only a point contact is reached between the register pins and the printing plate, which is not suitable for an exact positioning.

The present invention attacks the problem fundamentally: to create an alignment system, of the type previously described, whereby, on the one hand, an absolute centering between the respective printing plates and their related masks is possible and, on the other hand, an exact positioning of the printing plate on the printing roll is possible. The centering can be repeated as often as desired and without troublesome adjustments.

According to the invention these things are accomplished through the following: the stamping machine exhibits at least two punches possessing the same rectangular profile for the punching of register holes in a straight line to one another along a top end of the printing plate and mask and also exhibits a side chock; the pre-mount table and the bending device exhibit register pins which match the said register holes with respect to size and spacing, whereby the register pins are so constructed that they, at least in their width, are an exact fit for the said register holes. Hereby it is appropriate, that the striking surface of the side chock lies on a connecting line which makes a right angle with a line connecting the said register holes. Since, according to the invention, the register holes are in a straight line to one another and the connecting line of the register holes makes a right angle with a line running straight along the striking surface of the side chock, there results a positioning of the printing plate and the mask independent of any inaccurate cutting of the same. In addition, it results thereby that the register pins are perfectly matched to the register holes in their spacing and positioning with regard to the side chock; and, as to their width, said pins fit perfectly in the register holes; an exact centering between the printing plate and the mask in the longitudinal direction is reached and, indeed, can be repeated whenever desired and without optical measurement, but rather, uniquely, through the mutual exactly matched positioning of the register holes and register pins. In this respect, the rectangular style of the register holes and the register pins plays a necessary role, that, as a result, in comparison to the customary round register pins and holes, an aligned arrangement is guaranteed, in comparison to the spotty arrangement found in the present state of technology. Since, again conforming to the invention, the bending device for the bending of the top side of said printing plate also possesses the register pins, the printing plates will be bent free from any real movement of the plate edge, in such a manner that the bent edge, when fastened in the fastening channel, runs absolutely parallel to the roller axis and will, thereby, attain an exact positioning in the lateral direction. The blocking piece which is set in the fastening channel thereby guarantees that every printing plate is continually positioned the exact same as those previously, such being accomplished, likewise, without optical measurements.

In advantageous designs of the invention, the side chock of said stamping machine consists of two rectangular pegs arranged in spaced relation to one another, whose relative midpoint distance is equal to the circumference of the printing roll reduced by the width of the fastening channel. This construction of the chock gives the possibility that every printing plate, regardless of uncertainty such as unevenness along its longitudinal edge, can always be fastened, in the printing direction, in the exact same position on the printing roll, because this same segment of the longitudinal edge of the printing plate, which contacts the chock pegs on the stamping machine, also contacts, in the mounted state on said printing roll, the blocking piece in the fastening channel.

According to the invention, it can furthermore be useful if one of the register pins of said pre-mount table is so constructed that it fits perfectly the related register hole in its length as well as its width, and the other register pins possess a length of such a construction that there results a clearance, or gap, between the pin and the related hole on both sides of said pin. Through the all-round fit of this one register pin, there results in addition to the exact positioning of the printing plate and the mask in the longitudinal direction, moreover, an exact positioning also in the lateral direction, whereas the side clearance gap in the remaining holes makes possible the compensation for expansion of the printing plate or the mask.

Inasmuch as an alignment of the printing plate on the bending device is only necessary in one direction, that being perpendicular to the bending force, the bending devices register pins, in an embodiment of the invention, are constructed, as to their length, in such a manner that there is present on both sides a clearance or gap with respect to the longitudinal edges of the register holes in said printing plate. This clearance makes possible, during the weighting down of the printing plate on the bending device, the entire equalization of expansions along the lateral plane of said printing plate.

Furthermore, it is advantageous in accordance with the invention, if the blocking piece consists of a base plate of truncated-cone form, whose profile matches that of the fastening channel, whereby the width of the top side of said base plate is greater than the opening of said fastening channel; and also consists of a flat head screw which is insertable into a tap boring of the base plate through the opening of said fastening channel, and whose head diameter is larger than the width of the opening of said fastening channel. For the purpose of setting the blocking piece, the fastening channel shall be drilled with the help of a boring gauge in such a manner that the flat head screw while in its drawn up position sets in the fastening channel with its screw head in a sunken setting. Moreover, the base plate is measured out in such a manner that it fits suitably in the fastening channel. In order to make the placing of the base plate easier, it is, in accordance with the invention, again advantageous if the base plate is made of magnetic material. With this it is possible, after shoving the base plate from side to side in the fastening channel, to lift up said base plate from the bottom of the fastening channel with the help of a strong permanent magnet and to bring said base plate into such a position that it can be fastened with the flat head screw. In the case where the base plate must be inserted into the fastening channel from above, for example in the case of old machines being fit with this blocking piece for the first time, it is advantageous if the bottom side edges of the base plate are machined down and tapered in such a manner that the shape facilitates the edgewise insertion of the base plate through the opening of the fastening channel. This shaping of the plate makes possible the insertion into the channel of a much thicker base plate than would otherwise be possible. In accordance with the invention it is useful if the base plate possesses a thickness of five to eight millimeters in order to guarantee an absolute shake secure setting of the flat headed screw in the base plate. It can furthermore be of advantage if the flat head screw is fixed in the base plate by means of a metal adhesive. Especially for cylinder and flat bed offset printing machines, it is useful for the invention if the blocking piece consists of at least two register pins fastened on the forward wall of the cavity in the plate cylinder or, as the case may be, the printing foundation, bed, whose profile matches that of the positioning slots.

Through the rigid and permanent arrangement of the register pins on the wall of the cavity, an attachment point is produced whose position does not change along the circumferential direction of the plate cylinder and also remains unmovable while changing from one mounted plate to the next. In accordance with the invention, an absolute defined position for the printing plate is obtained on the plate cylinder or, as the case may be, printing bed, so as to exclude all uncertainty which could result through the movement of a fastening rail in connection with the positioning preparations; such movement during preparation being made necessary by the present state of technology in which the register pins are adjustably attached to the fastening rail.

With the positioning preparation disclosed by the present invention, the exact printing position is reached through one time fastening whereby the register pins serve as guides for the hole openings in the printing plate and the register pins which are in an exact straight line form a defined mounting surface.

In the embodiment of this invention it can be useful if the register pins are formed out of a common base molding. This presents a structural simplification through which the register pins need not be separately mounted every time, but rather can be fastened simultaneously through the mounting of the base molding.

Furthermore, an advantageous embodiment exists that at least one register pin, lying preferably somewhat in the middle of said base molding, matches exactly the measurements of the related register hole. The result of this embodiment is that the printing plate cannot shift in the lateral direction and consequently not only do the printing plates remain perfectly fixed on the foundation, for example, the plate cylinder, in the printing direction, that is, the circumferential direction, and remain in alignment with respect to one another, for example in connection with color printing, but they also remain fixed in the lateral direction, that is, perpendicular to the circumferential direction.

The same result can also be achieved if at least one of the holes lying preferably somewhat in the middle of the printing plate matches exactly the measurements of the related register pin. While the first alternative has the advantage that the holes in the printing plate can all be stamped the same size, the second alternative has the advantage that the register pins can, in relation to one another, all be the same size.

A further useful realization of the invention can therein consist that the register holes of the printing plates are somewhat longer than the related register pins so that the expanding width of the printing plate due to the pressure of printing can be compensated for.

The embodied device, in accordance with the invention, therefore possesses the advantage that the printing plates after being fastened, are always immediately fixed in a very precise position on the plate cylinder or the printing bed. Especially important in connection with the preparation of color printing work, is that the printing plates, which are arranged behind one another on different plate cylinders or printing beds, are always immediately exactly aligned with respect to one another.

As follows from the previous discussion, the alignment system according to the invention makes possible on the one hand an absolute centering arrangement of the printing plate and its mask during the pre-mount of the printing plate up to the ready-to-print state and on the other hand an exact fixing of the printing plate in the longitudinal as well as lateral direction on the printing roll, which is repeatable for every printing plate free of possible inaccuracies in the arrangement of the printing plate itself. As a result, the positioning, in accordance with this invention, of the printing plate is possible without any aid of optical measuring means. A further vital advantage of the alignment system according to this invention is that it can also be subsequently built into already existent printing machines.

DETAILED DESCRIPTION OF THE DRAWING

The example embodiment presented in the accompanying drawings will more precisely illustrate the invention. They show:

FIG. 1 is a perspective view of a stamping machine according to the invention;

FIG. 2 is a view of a printing plate punched out with help of the stamping machine according to FIG. 1;

FIG. 3 is an inspection view of a pre-mount table according to the invention with superimposed printing plate and mask;

FIG. 4 is an enlarged detailed view of IV in FIG. 3;

FIG. 5 is a bending device according to the invention;

FIG. 6 is a view of an offset rolling printing press with mounted printing plates;

FIG. 7 is a cross sectional view of a blocking piece according to the invention;

Figure 8:
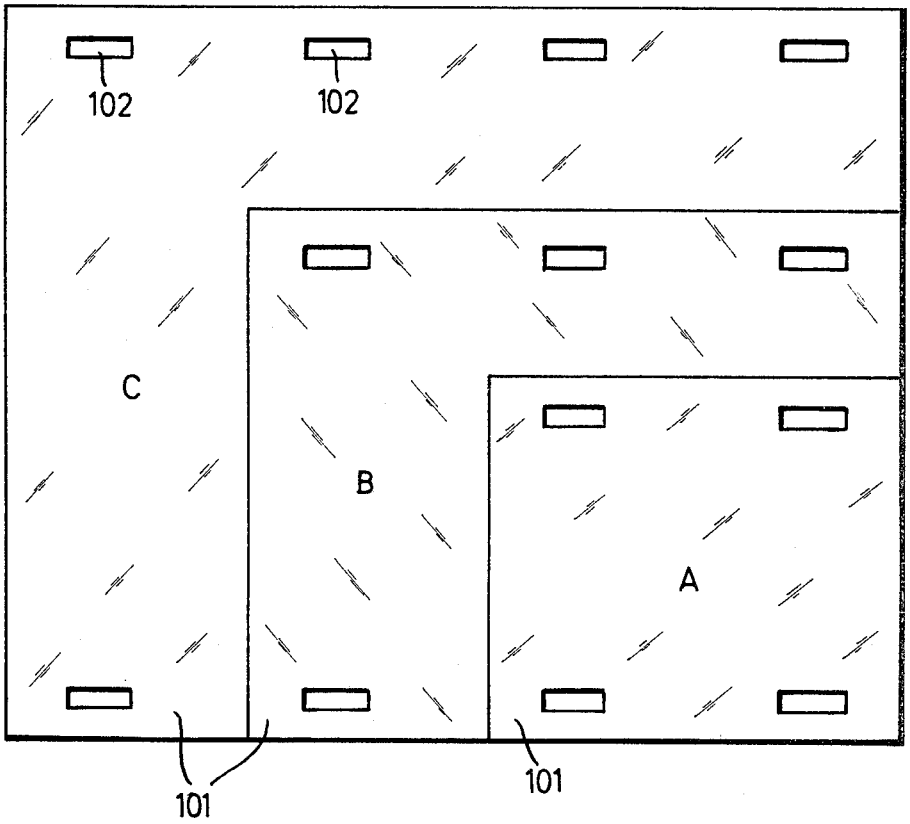
FIG. 8 is a top view of three different sized printing plates lying atop one another.
Figure 11:
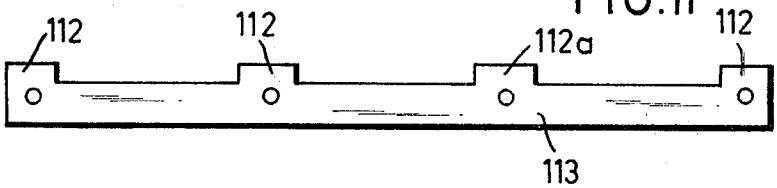
FIG. 11 is a top view of a base molding with several register pins.
Figure 12:
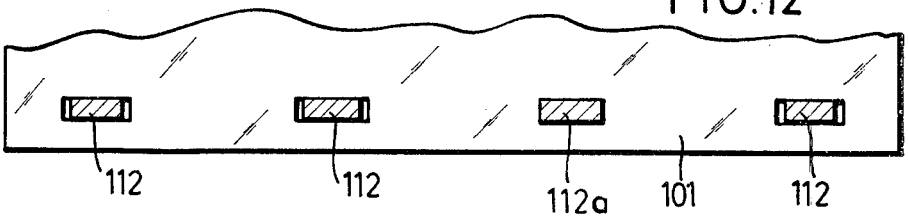
FIG. 12 is an edge cut of a mounted printing plate.

As FIG. 1 shows, a stamping machine 1 consists of a ground plate 3 laid upon a frame 2. On one top side of the ground plate 3, in the represented example, four punch housings 4 are in arranged distances from one another, operational for purposes of this example by means of a connecting shaft 6 and motor driven lever arm 5; punching pegs, rectangular in profile, are present, whose lateral sides are in a straight line with one another and which are all of the same size. On one longitudinal side, the ground plate 3 shows these relatively spaced rectangular chock pegs 8 and indeed two chock pegs. The mid point distance of these two chock pegs 8 corresponds to the circumference of the printing roll 9, see FIG. 6, reduced by the width of the fastening channel 10 of the printing roll 9. The connecting line of the lined-up punching pins makes a right angle with a connecting line of the strike surfaces of said chock pegs 8. The punch housings 4 serve simultaneously as gauges to regulate just how far in from the edge of the printing plate the register holes are to be stamped. There could also be gauge pins provided which are arranged staggered behind one another on the lateral edge of the stamping machine. That is, on the same edge as the punch housings are on. These gauge pins can be retracted or raised as desired by hand or hydraulic action.

FIG. 2 shows a printing plate 11 which has been punched out by the previously described stamping machine. This printing plate 11 shows, on the top side, four register holes corresponding to the number of punching pegs of the stamping machine. These register holes 12 are all the same size and lie on a connecting line which makes a right angle with the line of the longitudinal edge of the printing plate. Said longitudinal edge being that edge which contacts chock facings 8.

FIG. 3 shows a pre-mount table 13, upon which are laid a printing plate 11 in accord with FIG. 2 as well as a mask 14 which has likewise been punched out by the stamping table according to FIG. 1. The pre-mount table 13 shows three register pins 15, which fit in the register holes 12 of the printing plate and the mask and are a matching fit as to their width, while as to their length, they are made such that to the right and to the left side, a gap is present between the pins 15 and the holes 12. In addition to these, the pre-mount table 13 shows one register pin 16, which can be seen best in FIG. 4, which is a match on all sides for the register hole, that is, the pin is a perfect fit for the hole in its width as well as in its length.

After the printing plate has been prepared for printing by exposure and etching, it is bent at its lateral edge in a bending device 17, see FIG. 5. To accomplish this, the printing plate is placed with its register holes 12 on the register pins 18 of the bending device 17, which serve as positioning pins. These register pins 18 are designed in such a way that, as to their width, they are a perfect fit for the register holes 12 and, as to their length, there is built in a gap between the pin and the hole on both the left and right side of said pin, as is also demonstrated by the register pin 15 of pre-mount table 13.

FIG. 5 shows a principal view of the bending device 17, which consists of a frame 19 with support or base plate 20. At the top edge of the base plate 20, the register pins are mounted on the frame 19 so as to be retractable, in order that, after the printing plate has been positioned on the register pins, and this printing plate has become held securely in place on the mounting plate 20 by a heavy clamp 21, then the register pins are retracted and the printing plate is bent at its top side by use of a bending beam, lever 22.

After the bending preparation, the printing plate which is bent on both ends is stretched out on the printing roll 9 of an offset rolling printing press 23, see FIG. 6. Thereby, the printing plate 11 is placed in such a way that it lies with the end of one of its longitudinal sides abutting on the blocking piece 24 in the fastening channel 10. As FIG. 7 shows, the blocking piece 24 consists of a base plate 25 with a profile of truncated cone form, whose profile matches that of the fastening channel 10, whereby the width of the top side of said base plate 25 is larger than the width of the opening of said fastening channel. The base plate 25 shows a screw tapping into which a flat headed screw 26, which is stuck through the opening of said fastening channel is screwed. The head diameter of said flat head screw 26 is larger than the opening width of said fastening channel 10. To accomplish this end, the fastening channel 10 is drilled with the help of a bore gauge before the flat head screw has been screwed in, so that the head of said flat head screw, while in the screwed in state, fits in the channel with its screw head in a sunken setting. The base plate 25 advantageously is made of magnetic material. The underside edges 27 of said base plate 25 are tapered off. Metal adhesive 28 spread in the screw tapping serves to hold the flat headed screw 26 secure in the base plate 25 during shaking.

The offset printing plates 101 designated by the letters A, B and C in FIG. 8 are seen with punched holes 102 on both the front and back edges. The distance of holes 102 perpendicular to the printing direction is constant. Also the distance of holes, on any one printing plate, is constant in the printing direction.

Figure 9:
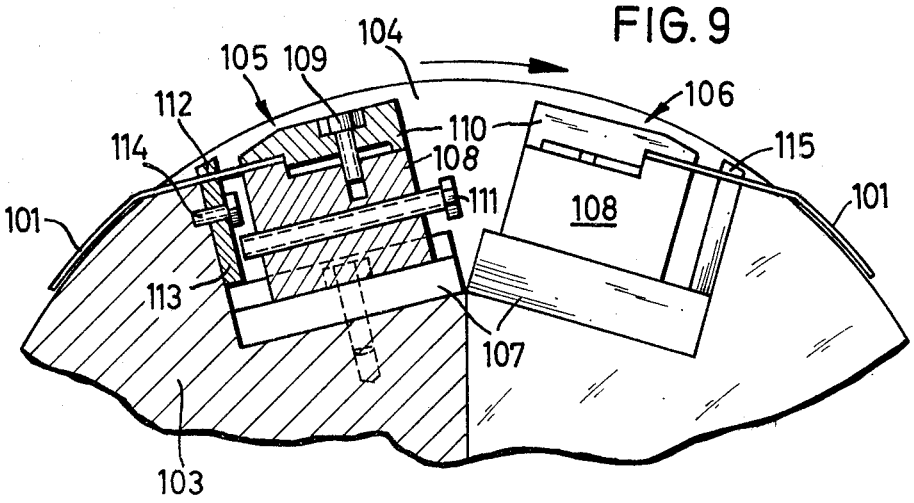
FIG. 9 is a cutaway view, from the side, of a plate cylinder cut along the jagged line X—X in FIG. 10.
Figure 10:
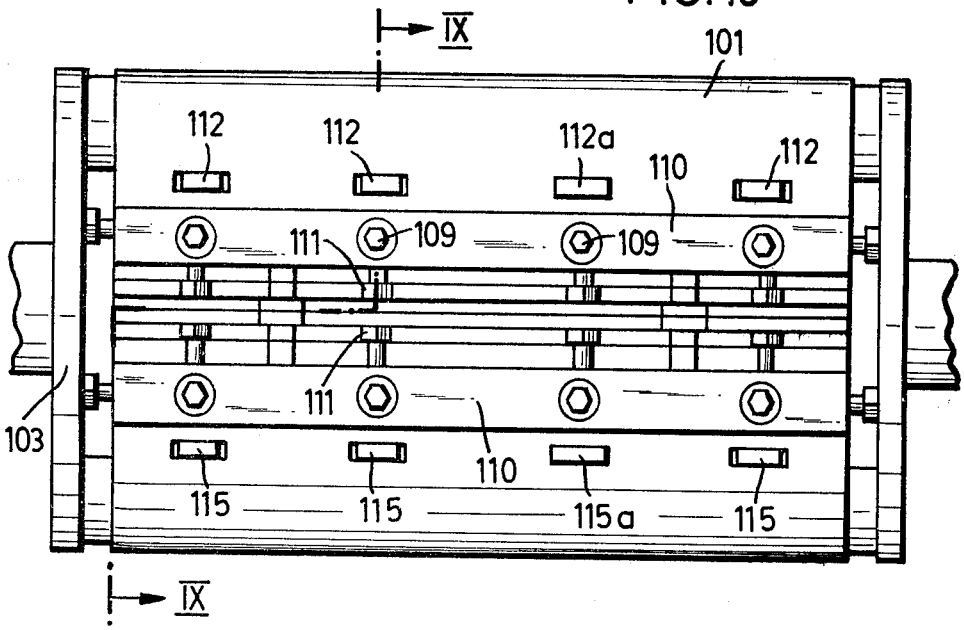
FIG. 10 is the same plate cylinder from a top view.

The plate cylinder 103 set forth in FIGS. 9 and 10 possesses a cavity 104 in which two movable clamping devices 105, 106 are mounted. Every clamping device 105, 106 consists of a pedestal 107 to which is adjustably mounted a base part 108, to which a clamp 110 can be fastened with set screw 109. The printing plate 101 is fastened between the base part 108 and the clamp 110, so that said printing plate can be stretched on the printing cylinder 103 by using tension screw 111. In order that the printing plate 101 is always in the precise same position on the printing cylinder 103, register pins 112 are mounted on the wall of the cavity 104 between the clamping device 105 and the printing cylinder 103. Said register pins 112 are arranged on a common base molding 113. The fastening of the register pin 112 and also the base molding 113 to the wall of the cavity 104 can be accomplished with screw 114, so that subsequent shifting is no longer possible. In this manner, that is, with its front end held on the register pins 112, the printing plate 101 is always placed in a very precise position on the plate cylinder 103.

At its tailing end, the printing plate 101 with its holes 102 hung on register pins 15, is held fast in like manner in cavity 104 of the plate cylinder 103, thus preventing even the slightest movement.

The register pins 112*a*, 115*a* which lie toward the middle of the axial plane, are of a measurement exactly matching that of the related hole 102 in the printing plate 101 in order that said printing plate is also fixed in a very precise position on the plate cylinder 103 perpendicular to the printing direction. The length of the other register pins 112, 115 is on the other hand somewhat smaller than the length of the holes 102 in said printing plate 101 in order that the slight changes in width of the printing plate 101 caused by the pressure of printing, can be compensated for.

Figure 14:
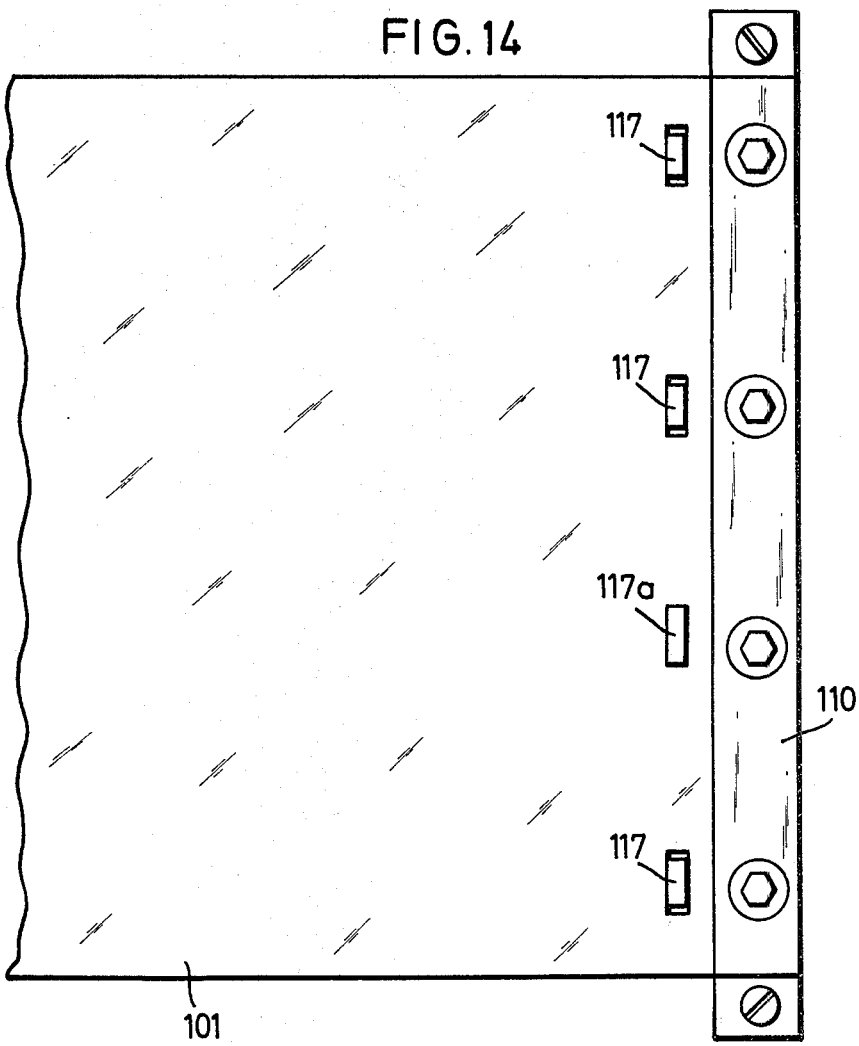
FIG. 14 is a top view of the same printing bed.
Figure 13:
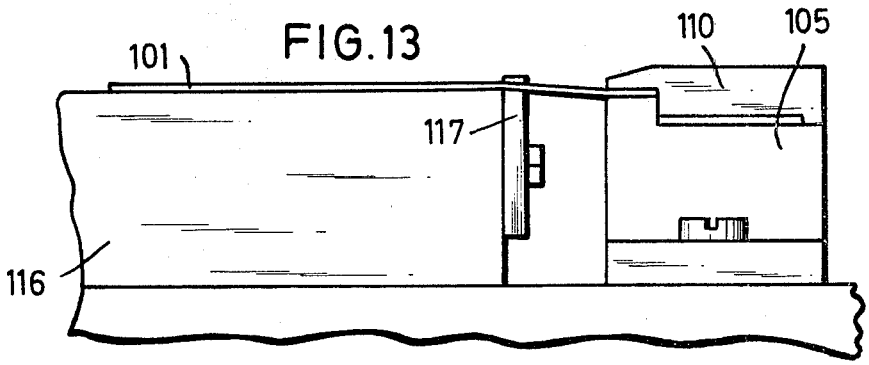
FIG. 13 is a side view of one side of a printing bed with mounted printing plate.

FIGS. 13 and 14 show a flat bed offset printing press. In front of a printing bed 116 is situated a movable clamping device 105 by which a printing plate 101, which is placed with its holes 102 on the register pins 117, can be stretched and fastened. Also in this case, again one register pin 117*a* is in its measurements, an exact match to the measurements of hole 102, while the length of the other remaining register pins 117 is somewhat smaller than the length of holes 102. In all other respects, the demands and equipment of printing plate 101 on the printing bed 116 follow similarly those of the printing plate 101 on the cylinder 103.

It should be understood that the foregoing relates only to preferred embodiments of the present invention, and that numerous changes and modifications can be made without departing from the spirit and the scope of the invention as defined in the following claims.

I claim:

1. In an alignment system for the positioning of a printing plate on offset printing presses, and including a stamping machine for the punching out of register holes in the printing plate and a related mask, a bending device for the printing plate, and a printing press having a printing roll across which a fastening channel is formed, the improvement comprising:

at least two stamping pegs on said stamping machine operative to punch rectangular register holes having corresponding linear edges in linear alignment with one another along a first straight line spaced inwardly from the edge at an end of a printing plate;

a pair of side chocks on said stamping machine, each side chock having a linear plate striking surface for contacting a side edge location of said plate;

said linear plate striking surfaces of said side chocks lying along a second straight line which is perpendicular to said first straight line, and the distance between the midpoints of said side chock surfaces being equal to the circumference of said printing roll reduced by the width of said fastening channel;

said bending device having rectangular register pins which match in spacing said register holes punched by said stamping pegs, the width of said register pins being an exact fit with the width of said register holes, and the length of said register pins being less than the length of said register holes to provide a gap between each end of each register pin and the confronting edge of the corresponding register hole;

said bending device being operative to bend said end of the printing plate along a bend line aligned with said first line and perpendicular to said second line; and blocking means located in said fastening channel to define an abutment surface for contacting the printing plate at each said side edge location previously contacted by said plate striking surfaces of said side chocks in said stamping machine, so that alignment of the printing plate on the printing roll is not affected by irregularities in the edges of the printing plate.

2. In an alignment system for the positioning of a printing plate on offset printing presses, and including a stamping machine for the punching out of register holes in the printing plate and a mask, a bending device for the printing plate, and a printing press having a printing plate receiving surface across which a fastening channel is formed, the improvement comprising:

at least two stamping pegs on said stamping machine operative to punch rectangular register holes having corresponding linear edges in linear alignment with one another along a first straight line spaced inwardly from the edge at an end of a printing plate;

a pair of side chocks on said stamping machine, each side chock having a linear plate striking surface for contacting a side edge location of said plate;

said linear plate striking surfaces of said side chocks lying along a second straight line which is perpendicular to said first straight line, and the distance betwen the midpoints of said side chock surfaces being equal to the length of said plate receiving surface reduced by the width of said fastening channel;

said bending device having rectangular register pins which match in spacing said register holes punched by said stamping pegs, the width of said register pins being an exact fit with the width of said register holes, and the length of said register pins being less than the length of said register holes to provide a gap between each end of each register pin and the confronting edge of the corresponding register hole;

said bending device being operative to bend said end of the printing plate along a bend line aligned with said first line and perpendicular to said second line; and blocking means located in said fastening channel to define an abutment surface for contacting the printing plate at each said side edge location previously contacted by said plate striking surfaces of said side chocks in said stamping machine, so that alignment of the printing plate on the plate receiving surface is not affected by irregularities in the edges of the printing plate.

3. In an alignment system for the positioning of a printing plate on offset printing presses, and including a stamping machine for the punching out of register holes in the printing plate and a related mask, a bending device for the printing plate, and a printing press having a printing roll across which a fastening channel is formed, the improvement comprising:

at least two stamping pegs on said stamping machine operative to punch rectangular register holes having corresponding linear edges in linear alignment with one another along a first straight line spaced inwardly from the edge at an end of a printing plate;

a pair of side chocks on said stamping machine, each side chock having a linear plate striking surface for contacting a side edge location of said plate;

said linear plate striking surfaces of said side chocks lying along a second straight line which is perpendicular to said first straight line, and the distance between the midpoints of said side chock surfaces being equal to the circumference of said printing roll reduced by the width of said fastening channel;

said bending device having rectangular register pins which match in spacing said register holes punched by said stamping pegs, the width of said register pins being an exact fit with the width of said register holes, and the length of said register pins being less than the length of said register holes to provide a gap between each end of each register pin and the confronting edge of the corresponding register hole;

said bending device being operative to bend said end of the printing plate along a bend line aligned with said first line and perpendicular to said second line;

blocking means located in said fastening channel to define an abutment surface for contacting the printing plate at each said side edge location previously contacted by said plate striking surfaces of said side chocks in said stamping machine, so that alignment of the printing plate on the printing roll is not affected by irregularities in the edges of the printing plate;

said fastening channel being open to said printing roll;

the blocking means comprising a truncated cone-shaped base plate whose profile matches that of the fastening channel, whereby the width of the top side of the base plate is larger than the width of the opening of said fastening channel; and a flat head screw insertable into a tap boring of the base plate through the opening in the fastening channel, the head diamter of said screw being larger than the width of the opening of said fastening channel.

4. Alignment system according to claim 3, wherein the base plate is configured to fit in the fastening channel.

5. Alignment system according to claim 3, where in the base plate is made of magnetic material.

6. Alignment system according to claim 3, wherein the underside edges of the base plate are tapered off.

7. Alignment system according to claim 3, wherein the base plate has a thickness of five to eight millimeters.

8. Alignment system according to claim 3, wherein the flat head screw is secured in the base plate by means of a metal adhesive.

* * * * *